US007972181B1

(12) United States Patent
Zhu et al.

(10) Patent No.: US 7,972,181 B1
(45) Date of Patent: Jul. 5, 2011

(54) COMPOUND FEMALE CONNECTOR

(75) Inventors: Yong-feng Zhu, Shenzhen (CN); Qing-liang Li, Shenzhen (CN); You-wen Liu, Shenzhen (CN)

(73) Assignee: Shenzhen Oversea Win Technology Co., Ltd., Shenzhen (CN)

( * ) Notice: Subject to any disclaimer, the term of this patent is extended or adjusted under 35 U.S.C. 154(b) by 0 days.

(21) Appl. No.: 12/954,950

(22) Filed: Nov. 29, 2010

(51) Int. Cl.
*H01R 24/00* (2011.01)

(52) U.S. Cl. ..... 439/660

(58) Field of Classification Search ..... 439/660, 439/607.01, 607.11, 638, 540.1, 541.5, 79–80
See application file for complete search history.

(56) References Cited

U.S. PATENT DOCUMENTS

| | | | | |
|---|---|---|---|---|
| 7,481,677 | B1 * | 1/2009 | Yi et al. | 439/607.01 |
| 7,686,656 | B2 * | 3/2010 | Zheng et al. | 439/660 |
| 7,727,026 | B2 * | 6/2010 | Qin et al. | 439/660 |
| 7,731,535 | B1 * | 6/2010 | Wan et al. | 439/607.4 |
| 7,909,652 | B2 * | 3/2011 | Yang et al. | 439/660 |
| 7,909,653 | B1 * | 3/2011 | Wan et al. | 439/660 |

* cited by examiner

*Primary Examiner* — Jean F Duverne
(74) *Attorney, Agent, or Firm* — Bacon & Thomas, PLLC

(57) ABSTRACT

A compound female connector is disclosed in the present invention. It has a first housing for fixing a first terminal set, a second housing for fixing a second set and a third terminal set, a terminal fixer for fixing all terminal sets after the first housing and the second housing are assembled together. The housings are connected together and enclosed by a shell. Each terminal set or the combination of terminal sets can support transmission specifications, such as eSATA, USB2.0 and USB3.0. A three-in-one female connector is provided so that the present invention can provide a single slot for different kinds of connectors. It saves cost and space for electronic products.

8 Claims, 8 Drawing Sheets

10

COMPOUND FEMALE CONNECTOR

FIELD OF THE INVENTION

The present invention relates to a compound female connector. More particularly, the present invention relates to a compound female connector supporting USB 2.0, USB 3.0 and eSATA specifications when different connectors are connected.

BACKGROUND OF THE INVENTION

With development of present computers and electronic devices, it is always a target for people to pursue high and efficient transmitting speed of data. The same purpose also pushes the industry to set up more advanced specification of data transmission. However, transition of different specifications of data transmission is limited not only by available technology but also people who own the devices with old specification. The later exists because users hope the devices can be used for a long time.

Meanwhile, market demands lead to more compact electronic devices. In addition to simplified internal design of electronic devices, external slots are needed to be selected for the maximum interfaces. Otherwise, the expectation mentioned above can not be fulfilled. For example, universal serial bus (USB) 2.0 specification is the most applicable interface for data transmission. A laptop might have three to seven USB 2.0 connector slots (female connectors) for connecting peripheral products, such as a mouse, speaker or a card reader. However, with the size of laptops becoming smaller and more compact, less number of USB 2.0 female connectors can be fabricated in the available space within the laptop, not to mention other connectors with different data transmitting specifications. For an external hard disk drive, a connector for higher data transmission adopts external serial advanced technology attachment (eSATA) or even USB 3.0 specification. Without female connectors in the laptop, users can not access the external hard disc drive. It is difficult for laptop designers to choose suitable combination of connectors.

Please refer to FIG. 1. U.S. Pat. No. 7,517,253 discloses a compound female connector for USB 2.0 and eSATA specifications. The female connector has a casing, an eSATA terminal set and an USB terminal set. The casing has a cavity and a terminal seat being disposed in the cavity. The eSATA terminal set is mounted on the terminal seat and has side eSATA terminals and middle eSATA terminals. The middle eSATA terminals are disposed between the side eSATA terminals and mounted on the terminal seat. The USB terminal set is mounted on the terminal seat opposite to the eSATA terminal set and has multiple interior USB terminals and multiple exterior USB terminals. The exterior USB terminals respectively connect the middle eSATA terminals to transmit signals via the middle eSATA terminals. Therefore the female connector is compatible with USB 3.0 specification and is compact with the single terminal seat.

Those skilled in the art will know that '253 patent has below defects. First, it needs to form eSATA terminals exclusively for connecting with an eSATA connector. Total 9 terminals are used. That means various tools are required. It costs more than an eSATA female connector with single form of terminals. Second, '253 patent uses one housing to fix all terminals. Since the inner space of the housing is small, different kinds of terminals are not easy to get fixed one by one even if the assembly is done by machine. During assembly of the female connector, short circuit will easily occur to decrease the yield rate.

In order to overcome the defects mentioned above, the inventor came up with the present invention. Two housings are used to simplify assembly. The present invention has advantages of low cost and easy assembly.

SUMMARY OF THE INVENTION

This paragraph extracts and compiles some features of the present invention; other features will be disclosed in the follow-up paragraphs. It is intended to cover various modifications and similar arrangements included within the spirit and scope of the appended claims.

In accordance with an aspect of the present invention, a compound female connector for selectively connecting with different specifications of male connectors, the compound female connector comprises: a first terminal set, including a plurality of first terminals, each having a first contact for electrically connecting with a terminal of a first external male connector, and a first connecting portion, perpendicularly extending from the first contact, for connecting with an electronic device; a first housing, for fixing the first terminal set, having a first fixer for fixing the first contacts, a plate for guiding the first terminals so that the first terminals are parallelly arranged, and a pair of clamps on two sides of the first housing; a second terminal set, including a plurality of second terminals, each having a second contact for electrically connecting with a terminal of a second external male connector, a second connecting portion for connecting with the electronic device, and a second linking portion formed between the second contact and the second connecting portion; a third terminal set, including a plurality of third terminals, each having a third contact for electrically connecting with a terminal of a third external male connector, a third connecting portion for connecting with the electronic device, and a third linking portion formed between the third contact and the third connecting portion; a second housing, including a base, a plurality of trenches formed on the base for accommodating the second linking portions and the third linking portions, a pair of slots formed on two sides of the trenches for connecting with the clamps when the first housing and the second housing are assembled together, and a pair of stoppers for positioning the first fixers; a terminal fixer, having a plurality of holes, for parallelly fixing the first, second and third connecting portions; and a shell, fixed in the electronic device, for protecting the housings and terminals, and selectively accommodating one of the external male connectors. The second terminals and the third terminals are arranged interleavedly.

Preferably, the first terminal set supports external advanced technology attachment (eSATA) specification.

Preferably, the second terminal set supports universal serial bus (USB) 2.0 specification.

Preferably, combination of the second terminal set and the third terminal set comply with USB 3.0 specification.

Preferably, the second terminal set and the third terminal set have 4 terminals and 5 terminals, respectively.

Preferably, the second connecting portion and the second linking portion form an angle of substantially 90° therebetween.

Preferably, the third connecting portion and the third linking portion form an angle of substantially 90° therebetween.

Preferably, the shell further has a plurality of grippers for fixing the external male connectors.

DETAILED DESCRIPTION OF THE PREFERRED EMBODIMENT

The present invention will now be described more specifically with reference to the following embodiment. It is to be noted that the following descriptions of the preferred embodiment of this invention are presented herein for purpose of illustration and description only; it is not intended to be exhaustive or to be limited to the precise form disclosed.

Figure 1:
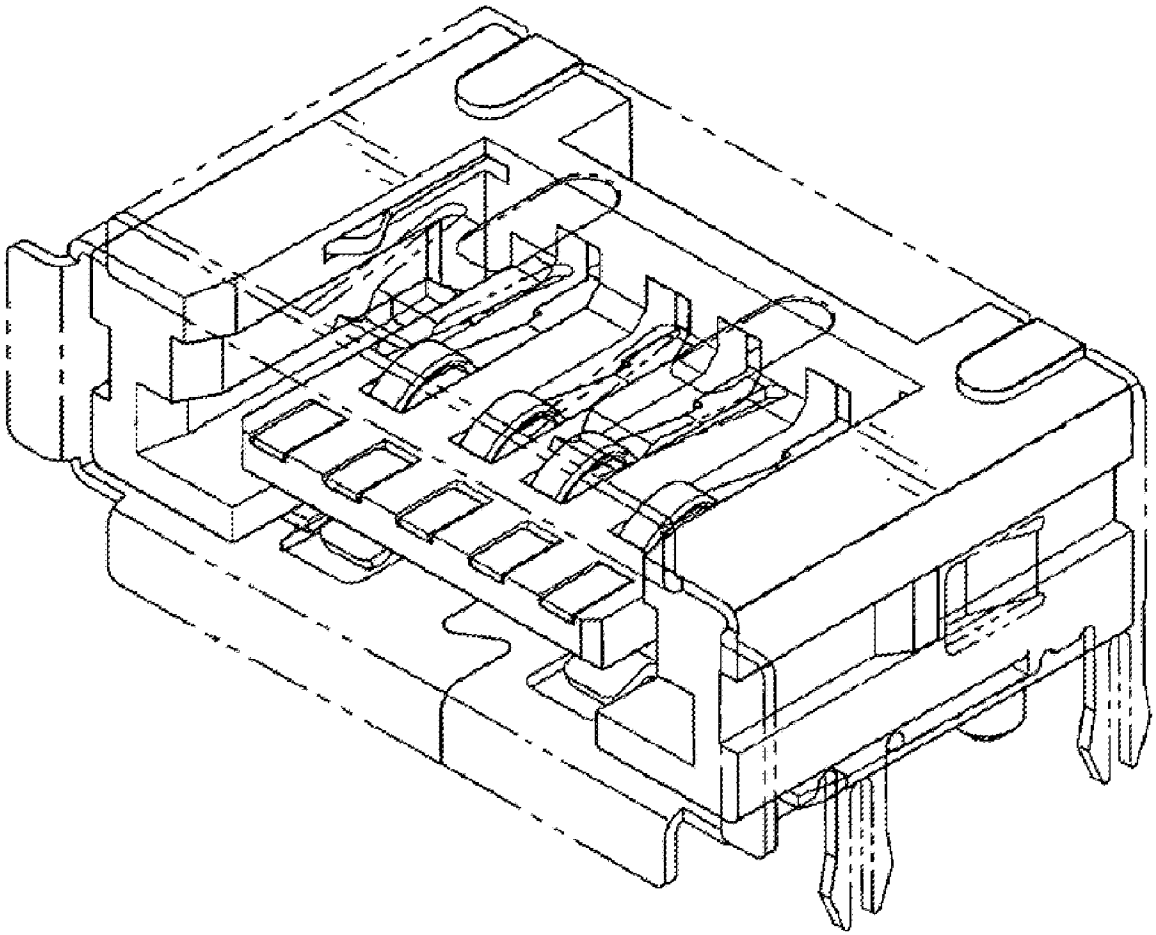
Fig. 1 (Prior Art)
FIG. 1 is a prior art female connector.
Figure 2:
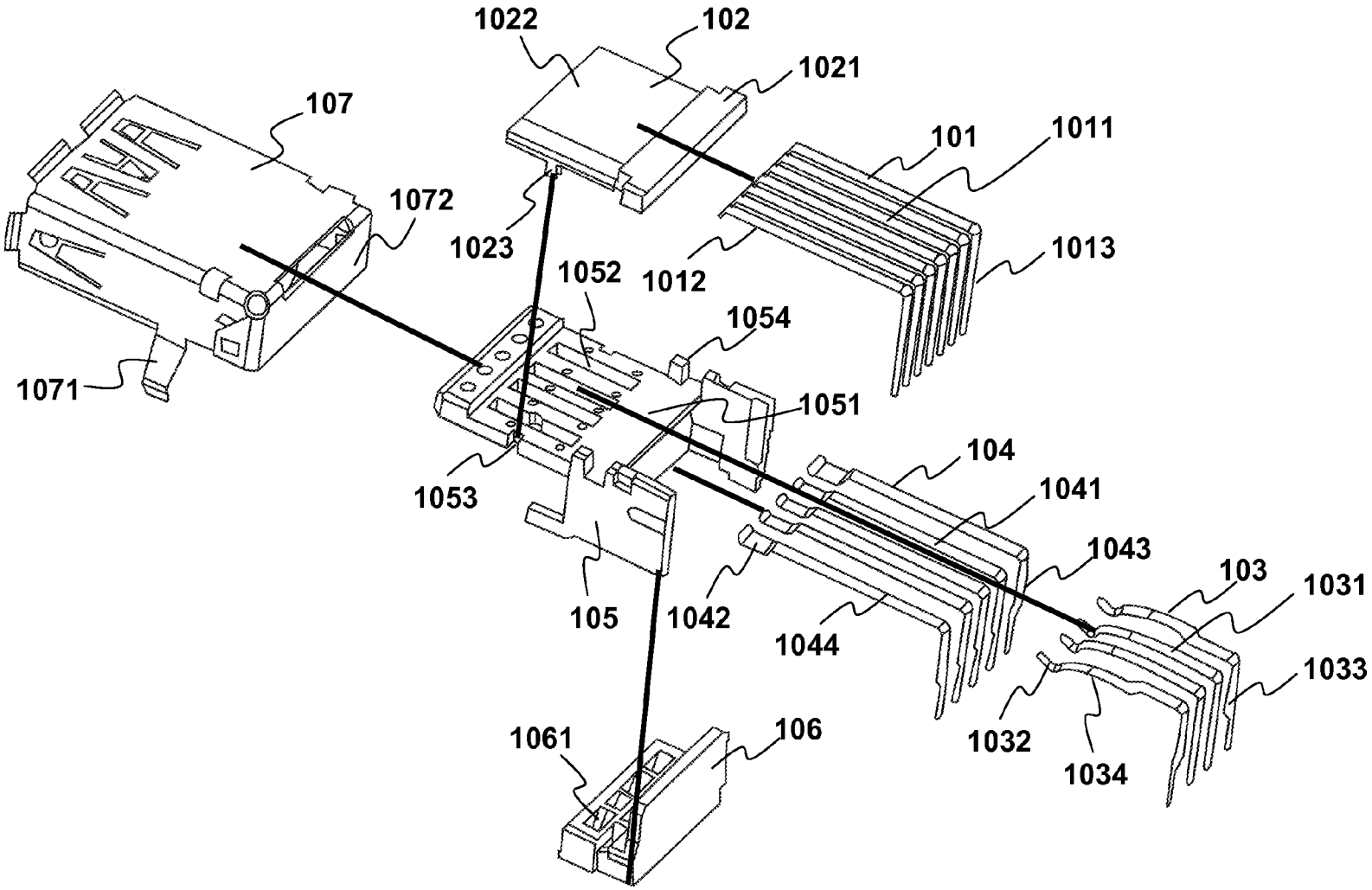
FIG. 2 is an explosive view of an embodiment of the present invention.
Figure 3:
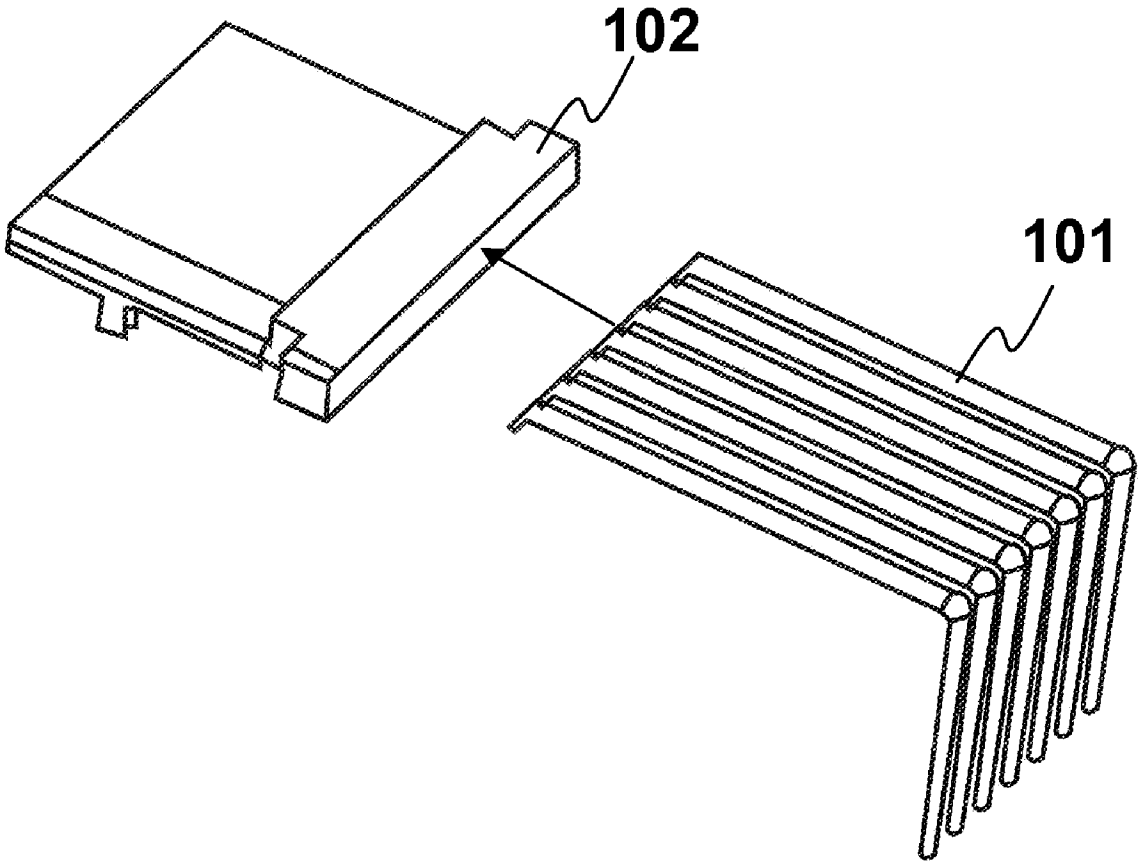
FIG. 3 illustrates how a first terminal set is assembled into a first housing in the embodiment.

Please refer to FIG. 2 to FIG. 8. The Figures illustrate an embodiment of the present invention. FIG. 3 shows an explosive view of a compound female connector 10. The compound female connector 10 has a first terminal set 101, a first housing 102, a second terminal set 103, a third terminal set 104, a second housing 105, a terminal fixer 106 and a shell 107.

The first terminal set 101 is composed of 7 first terminals 1011. Each first terminal 1011 has a first contact 1012 and a first connecting portion 1013. The first connecting portion 1013 is perpendicularly extended from the first contact 1012. The first contact 1012 can electrically connect with a terminal of a first external male connector (not shown). Here, the first external male connector is an external serial advanced technology attachment (eSATA) connector. The first terminal set 101 and first external male connector can support eSATA specification for data transmission.

The first connecting portion 1013 is perpendicularly extending from the first contact 1012, and connects with an electronic device (not shown). The electronic device can be a laptop, projector, mobile phone, printer, and so on.

The first housing 102 can fix the first terminal set 101, and has a first fixer 1021 for fixing the first contacts 1012. The first housing 102 also has a plate 1022 which guides the first terminals 1011 so that the first terminals 1011 are parallelly arranged and won't be disturbed by external force. Finally, a pair of clamps 1023 are formed on two sides of the first housing 102, and are used to integrate the first housing 102 with the second housing 105. In practice, a number of grooves (not shown) on the plate 1022 can be used to help guide the first terminals 1011.

The second terminal set 103 comprises 4 second terminals 1031. The second terminal 1031 each has a second contact 1032 which can electrically connect with a terminal of a second external male connector (not shown). The second terminal set 103 and the second external male connector support universal serial bus (USB) 2.0 specification. The second terminal 1031 also has a second connecting portion 1033 for connecting with the electronic device. The second terminal 1031 further has a second linking portion 1034 formed between the second contact 1032 and the second connecting portion 1033. It should be noticed that the second linking portions 1034 of the two among the four second terminals 1031 are formed outward for assembly purpose.

The third terminal set 104 comprises 5 third terminals 1041. Each third terminal 1041 has a third contact 1042 for electrically connecting with a terminal of a third external male connector. In this embodiment, the combination of the second terminal set and the third terminal set constitutes a standard USB 3.0 female terminal set. Thus, the third external male connector supports USB 3.0 specification. In addition, the third terminal 1041 further has a third connecting portion 1043 for connecting with the electronic device and a third linking portion 1044 formed between the third contact 1042 and the third connecting portion 1043. The second terminals 1031 and the third terminals 1041 are interleaved.

The second housing 105 comprises a base 1051, trenches 1052, a pair of slots 1053, and a pair of stoppers 1054. The base 1051 is to link and support all units on it. Trenches 1052 are formed on the base 1051 and can accommodate the second linking portions 1034 and the third linking portions 1044. The pairs of slots 1053 are formed on two sides of the trenches 1052, for connecting with the clamps 1023 when the first housing 102 and the second housing 105 are assembled together. The stoppers 1054 are for positioning the first fixers 1021.

The terminal fixer 106 has a number of holes 1061. The holes 1061 can fix the first, second and third connecting portions 1013, 1033 and 1043 so that all connecting portions are substantially parallel and fixed, thereby facilitating assembling of the compound female connector 10.

Last, the shell 107 is used for protecting the housings and terminals inside, and accommodating the plugged-in external male connector. Most importantly, a pair of grippers 1071 can fix the compound female connector 10 in the electronic device. A cover 1072 is used to cover the compound female connector 10 when assembly is done.

In order to illustrate how the compound female connector 10 is assembled, FIGS. 3 to 8 are provided.

Figure 4:
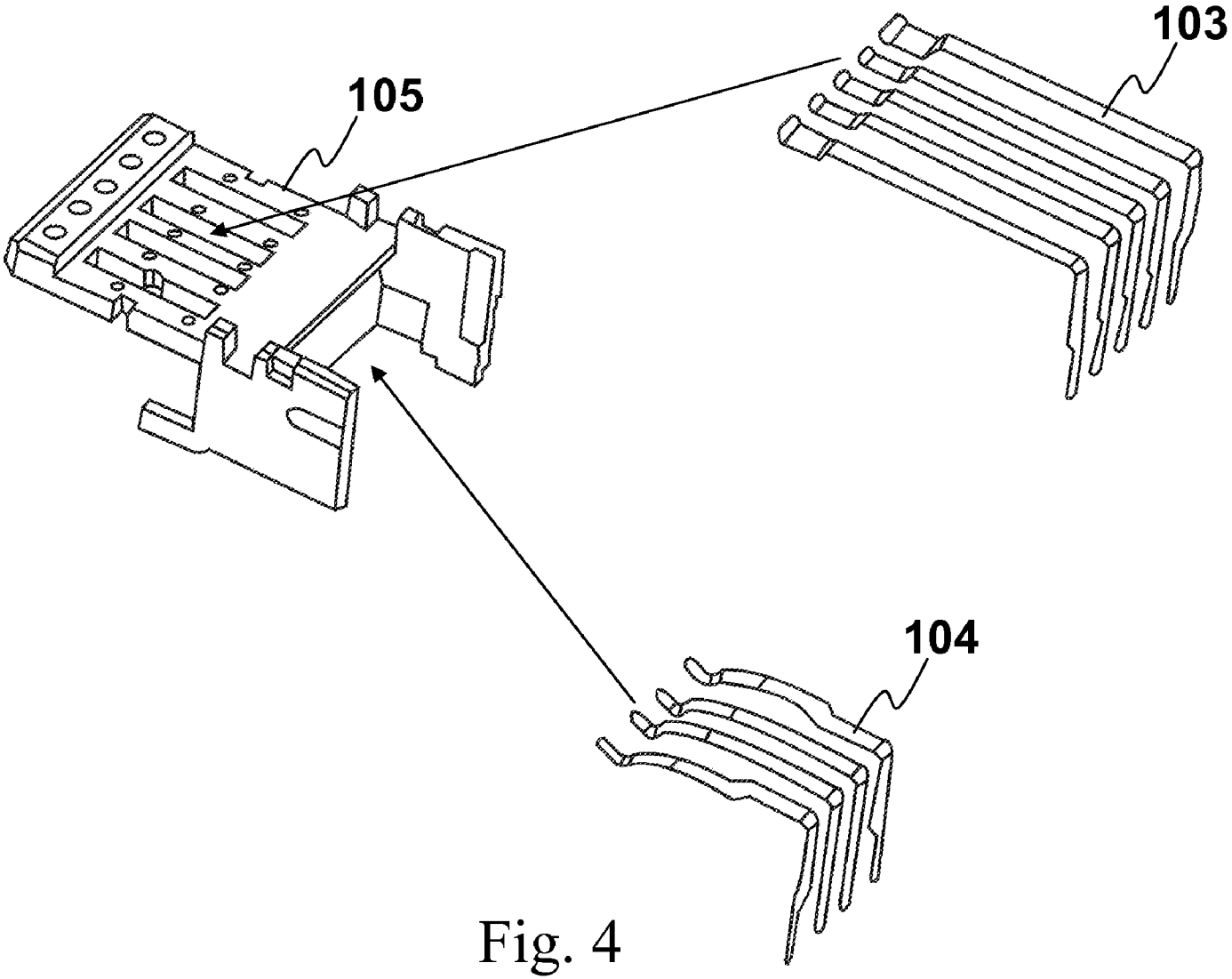
FIG. 4 shows how a second terminal set and a third terminal set are assembled into a second housing in the present embodiment.
Figure 5:
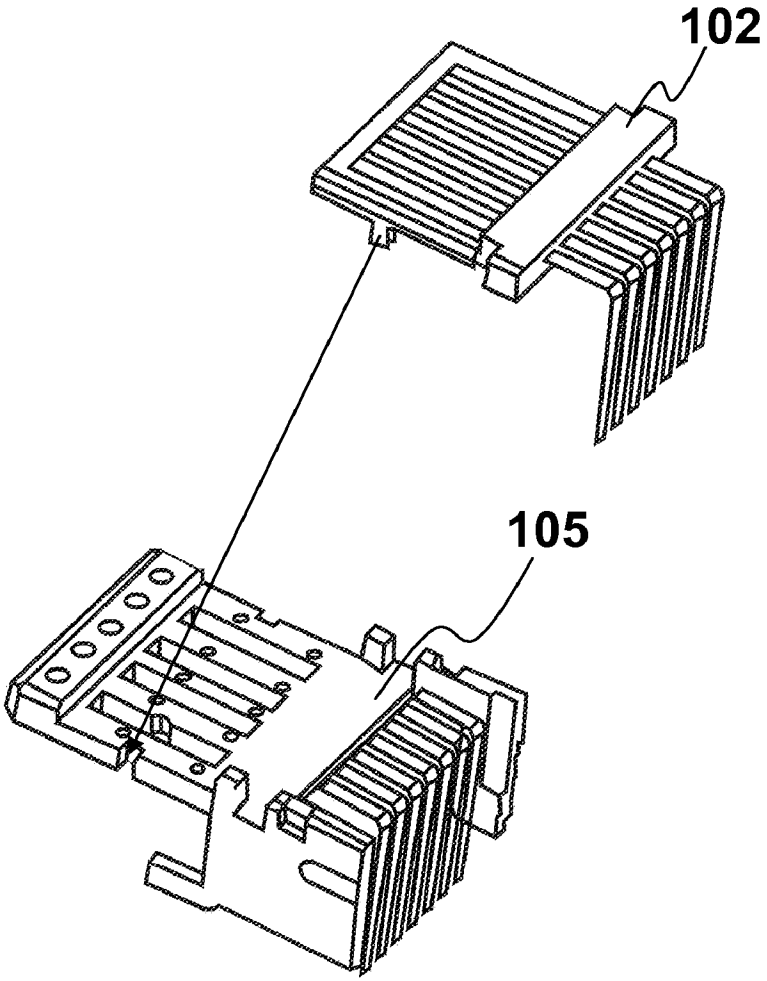
FIG. 5 illustrates the combination of the first housing and the second housing of the present embodiment.
Figure 6:
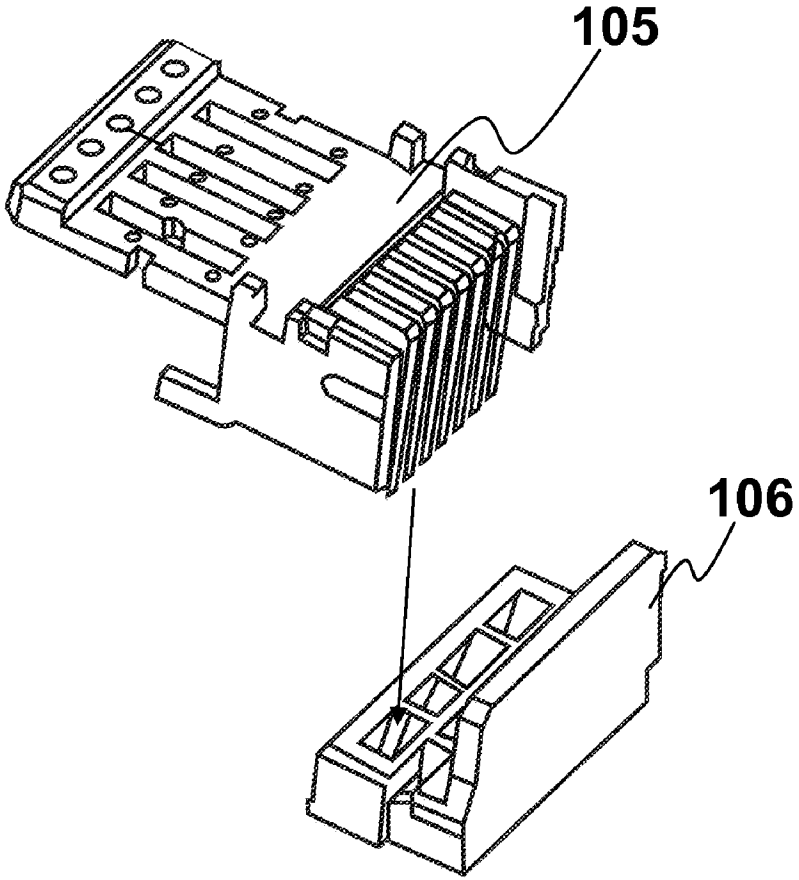
FIG. 6 shows the second housing connected with a terminal fixer in the present embodiment.
Figure 7:
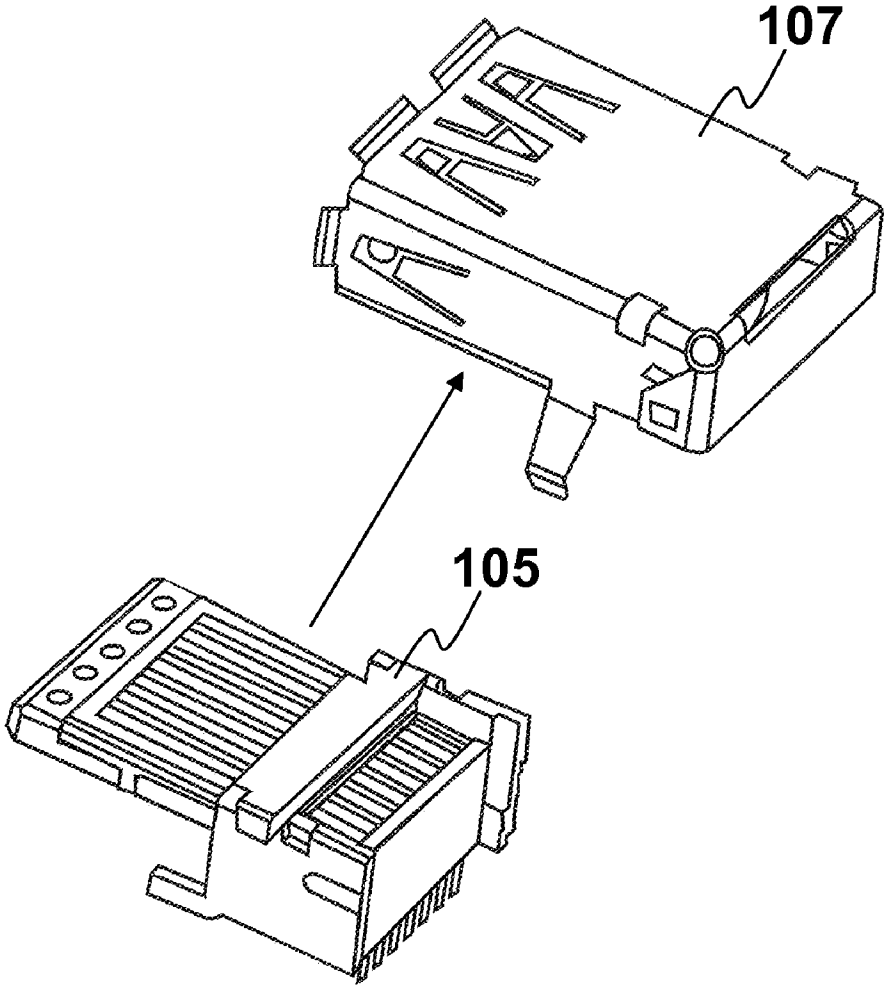
FIG. 7 illustrates assembly of a shell of the present embodiment.
Figure 8:
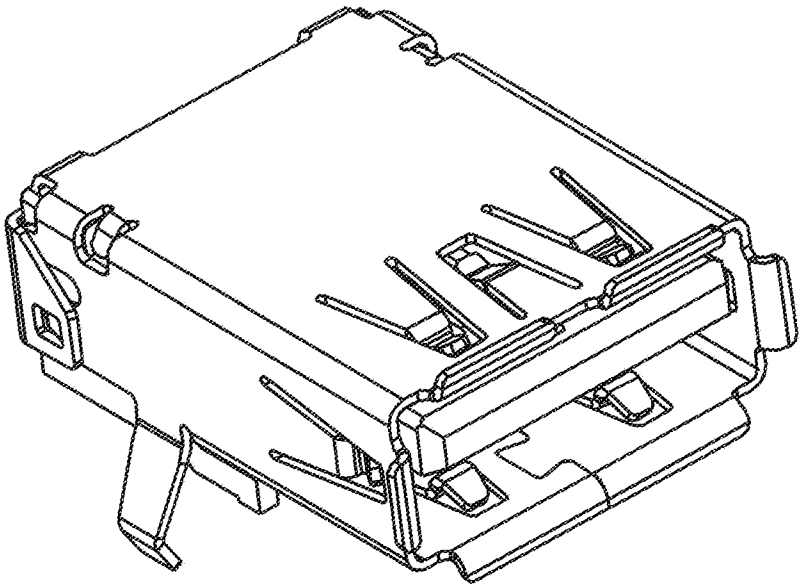
FIG. 8 shows the compound female connector of the present invention.

FIG. 3 shows how the first terminal set 101 is assembled into the first housing 102. The arrows indicate assembly connection between two elements throughout the drawings. FIG. 4 shows how the second terminal set 103 and the third terminal set 104 are assembled to the second housing 105. FIG. 5 illustrates the combination of the first housing 102 and the second housing 105. FIG. 6 shows the assembled second housing 105 is connected with the terminal fixer 106. FIG. 7 shows the last step to assemble the shell 107. The completed compound female connector 10 is shown in FIG. 8.

In the present invention, it should be emphasized that the second connecting portion 1033 and the second linking portion 1034 form an angle of substantially 90° therebetween. The third connecting portion 1043 and the third linking portion 1044 form an angle of substantially 90° therebetween.

While the invention has been described in terms of what is presently considered to be the most practical and preferred embodiment, it is to be understood that the invention needs not be limited to the disclosed embodiment. On the contrary, it is intended to cover various modifications and similar arrangements included within the spirit and scope of the appended claims, which are to be accorded with the broadest interpretation so as to encompass all such modifications and similar structures.

What is claimed is:

1. A compound female connector for selectively connecting with different specifications of male connectors, comprising:

a first terminal set, including a plurality of first terminals, each having a first contact for electrically connecting with a terminal of a first external male connector, and a first connecting portion, perpendicularly extending from the first contact, for connecting with an electronic device;

a first housing, for fixing the first terminal set, having a first fixer for fixing the first contacts, a plate for guiding the first terminals so that the first terminals are parallelly arranged, and a pair of clamps on two sides of the first housing;

a second terminal set, including a plurality of second terminals, each having a second contact for electrically connecting with a terminal of a second external male connector, a second connecting portion for connecting with the electronic device, and a second linking portion formed between the second contact and the second connecting portion;

a third terminal set, including a plurality of third terminals, each having a third contact for electrically connecting with a terminal of a third external male connector, a third connecting portion for connecting with the electronic device, and a third linking portion formed between the third contact and the third connecting portion;

a second housing, including a base, a plurality of trenches formed on the base for accommodating the second linking portions and the third linking portions, a pair of slots formed on two sides of the trenches for connecting with the clamps when the first housing and the second housing are assembled together, and a pair of stoppers for positioning the first fixers;

a terminal fixer, having a plurality of holes, for parallelly fixing the first, second and third connecting portions; and a shell, fixed in the electronic device, for protecting the housings and terminals, and selectively accommodating one of the external male connectors;

wherein the second terminals and the third terminals are arranged interleavedly.

2. The compound female connector according to claim 1, wherein the first terminal set supports external advanced technology attachment (eSATA) specification.

3. The compound female connector according to claim 1, wherein the second terminal set supports universal serial bus (USB) 2.0 specification.

4. The compound female connector according to claim 1, wherein combination of the second terminal set and the third terminal set comply with USB 3.0 specification.

5. The compound female connector according to claim 1, wherein the second terminal set and the third terminal set have 4 terminals and 5 terminals, respectively.

6. The compound female connector according to claim 1, wherein the second connecting portion and the second linking portion form an angle of substantially 90° therebetween.

7. The compound female connector according to claim 1, wherein the third connecting portion and the third linking portion form an angle of substantially 90° therebetween.

8. The compound female connector according to claim 1, wherein the shell further has a plurality of grippers for fixing the external male connectors.

* * * * *